United States Patent [19]

Yoshizawa et al.

[11] 3,939,634

[45] Feb. 24, 1976

[54] EMPTY BOBBIN SUPPLY DEVICE

[75] Inventors: Toshio Yoshizawa, Chiryu; Yasuo Yamada; Toshinori Taniguchi, both of Kariya; Tatsuo Kose; Kazuo Ohchi, both of Wakayama; Kiyokazu Hori, Sabae, all of Japan

[73] Assignees: Kabushiki Kaisha Toyoda Jidoshokki Seisakusho, Kariya; Daiwa Boseki Kabushiki Kaisha, Osaka, both of Japan

[22] Filed: Jan. 3, 1974

[21] Appl. No.: 430,513

[52] U.S. Cl. ..... 57/53; 57/52; 242/35.5 A

[51] Int. Cl.[2] ..... D01H 9/10

[58] Field of Search ..... 57/52–54, 34 R, 57/58.89–58.95; 242/35.5 A, 35.5 R, 35.6 R

[56] References Cited

UNITED STATES PATENTS

| | | | |
|---|---|---|---|
| 3,154,909 | 11/1964 | Urano et al. | 57/52 |
| 3,307,340 | 3/1967 | Nishii et al. | 57/53 |
| 3,318,078 | 5/1967 | Bahnson, Jr. et al. | 57/53 |
| 3,328,948 | 7/1967 | DuBuis et al. | 57/53 |
| 3,344,594 | 10/1967 | Takemura et al. | 57/53 |
| 3,447,297 | 6/1969 | DuBuis et al. | 57/53 |
| 3,791,126 | 2/1974 | Kose et al. | 57/53 |

*Primary Examiner*—John Petrakes

*Attorney, Agent, or Firm*—Wenderoth, Lind & Ponack

[57] ABSTRACT

An empty bobbin supply device for use in a doffing machine which travels in front of spinning units and is adapted for doffing a cheese and donning an empty bobbin in place thereof. This empty bobbin supply device has a reserve box, a reserve conveyor and a horizontal transfer conveyor, which are all positioned substantially in a vertical direction. An empty bobbin comes downwardly by gravity from the reserve box and is received between transfer plates of the reserve conveyor. The bobbin is then transferred downwardly by the circulating reserve conveyor, and in the absence of a bobbin on the horizontal transfer conveyor, the bobbin is delivered therefrom, while when a bobbin is present on the transfer conveyor, the bobbin remains on the reserve conveyor. The terminal of the horizontal transfer conveyor serves as a stand-by position for an empty bobbin in the doffing portion.

15 Claims, 11 Drawing Figures

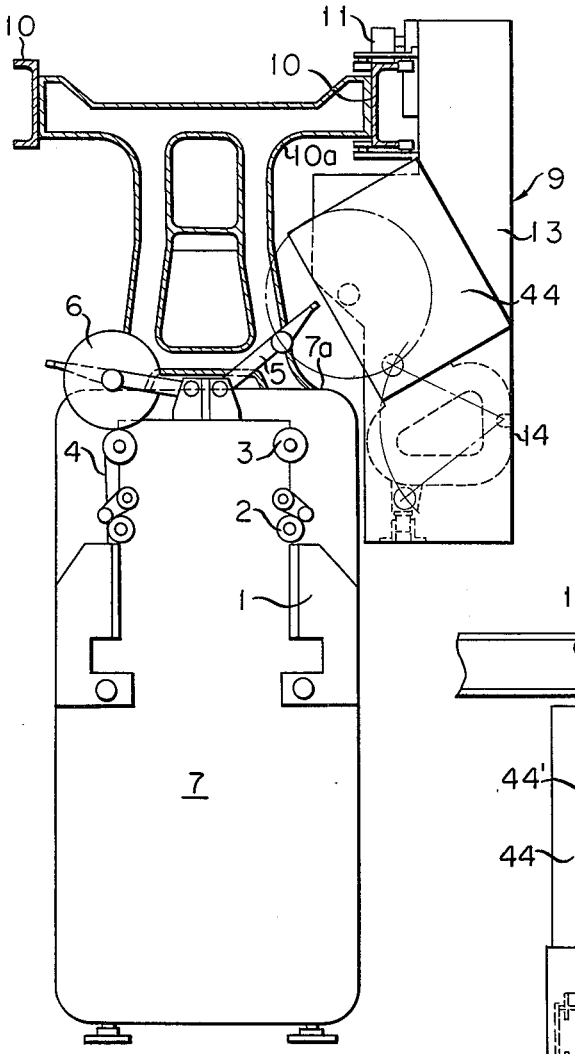
FIG. 1
FIG. 3
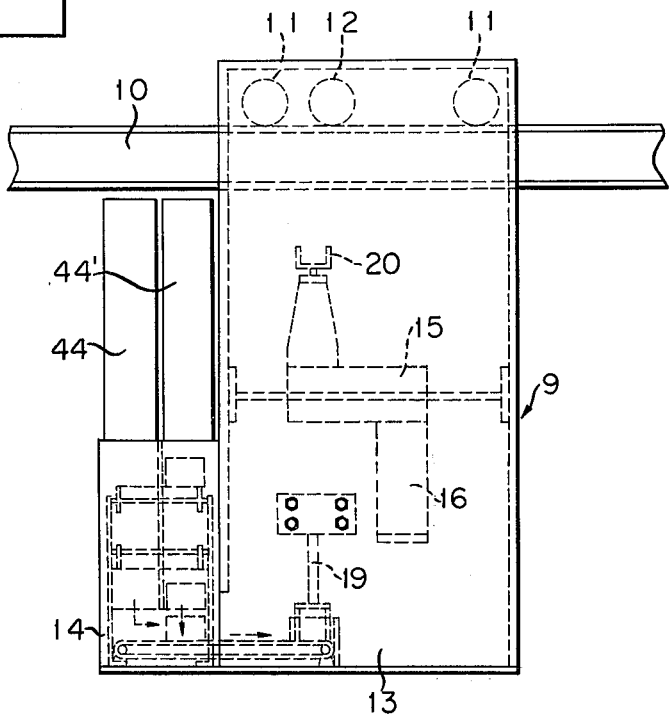
FIG. 2
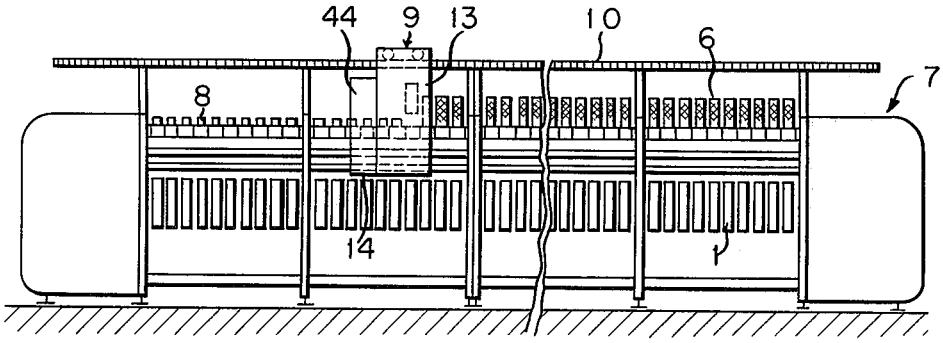

EMPTY BOBBIN SUPPLY DEVICE

BACKGROUND OF THE INVENTION

1. Field of the Invention

This invention relates to an empty bobbin supply device for use in an automatic doffing and donning machine in a spinning machine, and more particularly to an empty bobbin supply device for supplying empty bobbins, commensurate to the doffing operation, with a required position for donning means which travels in front of a plurality of spinning units for doffing a fully wound cheese and donning or mounting an empty or replacement bobbin in place thereof.

2. Description of the Prior Art

Hitherto, an automatic doffing machine has been known, which travels in front of a plurality of spinning units in a spinning machine for doffing a fully wound cheese from the respective spinning unit and donning or mounting an empty bobbin in place thereof. The doffing machine of the type described consists of a doffing mechanism adapted to remove a fully wound cheese from a winding position, a donning mechanism adapted to mount an empty bobbin in the winding position, a mechanism adapted to receive a cheese from the doffing mechanism and a supply mechanism adapted to supply an empty bobbin to the donning mechanism. However, for a continuous doffing operation by the doffing machine, it is mandatory that the doffing machine itself have a plurality of empty bobbins therein and travel in front of the spinning units, and that the size of the aforesaid doffing machine should be a minimum.

On the other hand, the empty bobbin supply mechanism consists of a box adapted to contain a plurality of empty bobbins therein and means for separately taking out the empty bobbins from the aforesaid box and for transferring same to a position required for the donning mechanism. However, such an empty bobbin supply mechanism suffers from disadvantages in that the mechanism has to have a large size, coupled with the complication of the construction of the means for taking out the empty bobbins from the box and for transferring same to a required position. For instance, according to U.S. Pat. No. 3,307,340, there is disclosed a device in which a box containing empty bobbins therein is placed under a donning mechanism, and the bobbins are taken out from the box by using a conveyor having receptacles to transfer same to the donning mechanism. However, this still suffers from disadvantages, such as the use of an excessively long conveyor and the need to provide an excessive amount of power to drive the device. Particularly, with this device, the bobbins which have been transferred by the aforesaid conveyor are directly supplied to the donning mechanism, so that the conveyor for taking out bobbins can operate in synchronism with the donning mechanism, and on the other hand, in the case of a failure of a satisfactory operation for taking the bobbins out of the box, the supply of bobbins to the corresponding spinning unit will be interrupted.

As is apparent from the foregoing, the conventional devices have drawbacks in that they are complicated in construction, large in size, costly and particularly inconvenient for use in a doffing machine of the type which travels in a suspended fashion from the top rail of the spinning machine, rather than travelling on the floor.

SUMMARY OF THE INVENTION

It is accordingly an principal object of the invention to provide an empty bobbin supply device having a simple construction, which supplies empty bobbins from a magazine box to a bobbin donning or mounting mechanism in cooperation with a continuous doffing operation.

It is another object of the invention to provide an empty bobbin supply device which renders the shifting of bobbins from a box to a transferring means smooth and is compact in construction, while obviating the need to bring the bobbin transferring operation from a reserve box to a bobbin donning or mounting mechanism into synchronism with the doffing operation, by providing a reserve box containing empty bobbins therein, a reserve conveyor which has transfer plates for transferring the bobbins and communicates with the reserve box, and a transfer means for transferring empty bobbins to the bobbin donning or mounting mechanism, all of which are arranged in a substantially vertical direction in the order described.

It is a further object of the invention to provide an empty bobbin supply device, in which, in addition to the vertical arrangement of the aforesaid mechanisms or components, the reserve box is mounted in an inclined position to thereby take advantage of available space, thereby increasing the capacity of the box receiving bobbins, while casusing the empty bobbins to roll downwardly by their gravity along the inclined surface of the reserve box, thus precluding the empty bobbins from remaining therein.

It is a still further object of the invention to provide an empty bobbin supply device which will prevent the so-called bridge phenomenon of the empty bobbins within the reserve box by causing the transfer plates of the circulating reserve conveyor to intermittently abut the bobbins in the lowermost layer within the reserve box for the purpose of imparting vibration to the empty bobbins held within the reserve box.

It is a still further object of the invention to provide an empty bobbin supply device, in which the reserve boxes and reserve conveyors are arranged in a plurality of rows and there is provided a control means adapted to switch the delivery of the empty bobbins which are to be delivered from the rserve conveyor one way or another, whereby a great amount of empty bobbins may be stored or contained therein and a cycle for supplying the empty bobbins may be extended to a great extent.

According to the present invention, there is provided an empty bobbin supply device for use in an automatic doffing machine which travels in front of a plurality of spinning units for doffing a fully wound cheese and donning an empty bobbin in place thereof, said empty bobbin supply device comprising: means for containing empty bobbins therein and having an opening in its bottom; an endless conveyor means located under said opening of said bobbin-containing means and adapted to carry empty bobbins separately thereon and transfer said bobbins by the circulating movement thereof; and a transfer means located under said conveyor means and adapted to receive bobbins comming down from said conveyor, in the absence of a bobbin on the transfer means, and transfer the bobbins to the donning mechanism.

The detailed construction and other characteristic features of the device according to the present invention are hereinafter described in detail with reference to the accompanying drawings.

BRIEF DESCRIPTION OF THE DRAWINGS

FIG. 1 is a schematic side view of an open end spinning frame provided with an empty bobbin supply device of the present invention;

FIG. 2 is a plan view showing, in its entirety, the open end spinning frame provided with an empty bobbin supply device of the present invention;

FIG. 3 is a plan view of a doffing machine;

DETAILED DESCRIPTION OF THE PREFERRED EMBODIMENTS

Figure 4:
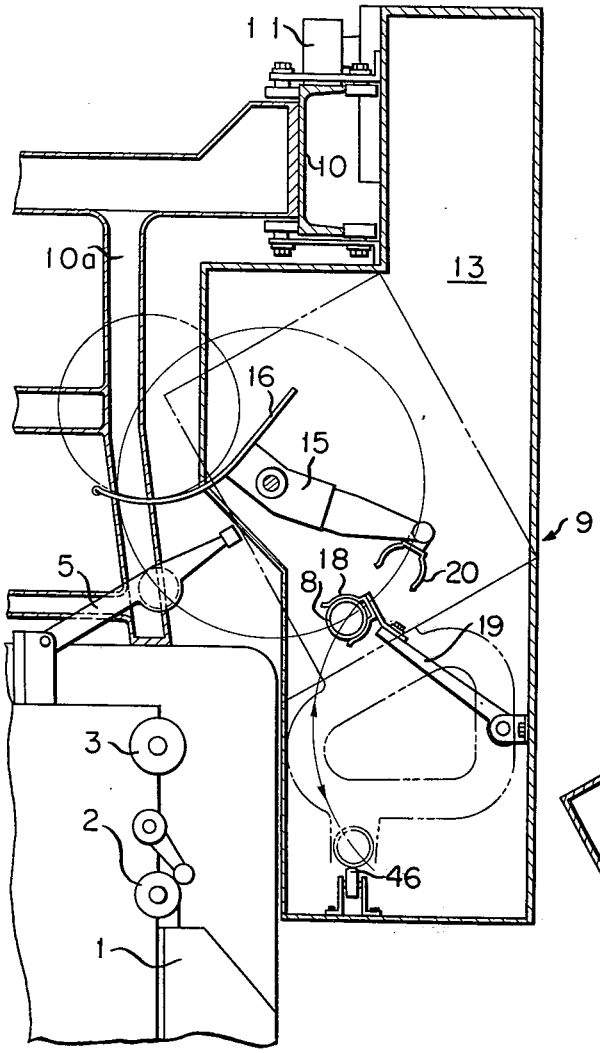
FIG. 4 is a cross-sectional side view illustrating a doffing portion of the doffing machine, and a spinning unit.

Referring now to FIG. 1, an open ended spinning machine 7 is provided with a feed roller, combing mechanism, rotary chamber, yarn draft mechanism and the like, and above this is a draft roller 2 for a spun yarn supplying yarn 4 to a grooved winding drum. A bobbin holder 5 resiliently mounts a bobbin against the grooved winding drum 3 for the formation of the yarn cheese 6. A plurality of spinning units are arranged on the machine 7 in a known manner.

As has been described earlier, the present invention is associated with a doffing and donning machine which travels along the front face of the open-end spinning machine of the type described for doffing the cheese 6 wound to a required size and donning an empty bobbin in place thereof, without interruption.

As shown in FIGS. 2 and 3, the doffing machine 9 consists of a doffing portion 13 incorporating doffing and donning mechanisms therein and a bobbin supply portion 14 provided adjacent to the side of the doffing portion 13, said doffing machine 9 being suspended from a rail 10 by rollers 11, which rail is provided above the spinning machine 7, and adapted to travel by means of a driving roller 12. When a fully wound cheese is prepared, the holder 5 is rotated upwardly by cam means provided in the doffing portion 13, the cheese 6 is thereby demounted from the winding drum 3, and the bobbin holder 5 is opened, whereby the cheese 6 thus released is received on receiving dish 16 of the rotary doffer 15 which has been rotated into position, thus doffing the cheese 6 (refer to FIGS. 3 and 4). In synchronism therewith, a supply arm 19 having a nipper 18 grasping an empty bobbin therebetween is rotated upwardly to thereby position the bobbin 8 within the rotational locus of a catcher 20 provided on the rotary doffer for supplying the bobbin 8 to the catcher 20 which has been rotated in position, after which the catcher 20 is further rotated to shift the bobbin 8 into position in the holder 5. Then, the holder 5 is closed to hold the bobbin 8 therein, whereby the bobbin is removed from the catcher 20. Then, the holder 5 is further rotated downwardly, and thus the bobbin 8 is rotated in contact with the winding drum 3, thus re-starting the winding operation. The cheese 6 thus doffed is transferred to the end of the frame by means of a conveyor located in the rear of the rotary doffer 15 or introduced into the doffing machine for further transfer to a desired position.

The bobbin supply portion 14 of the present invention for supplying bobbin 8 to the aforesaid bobbin supply arm 19 has a construction which will be described below.

Figure 5:
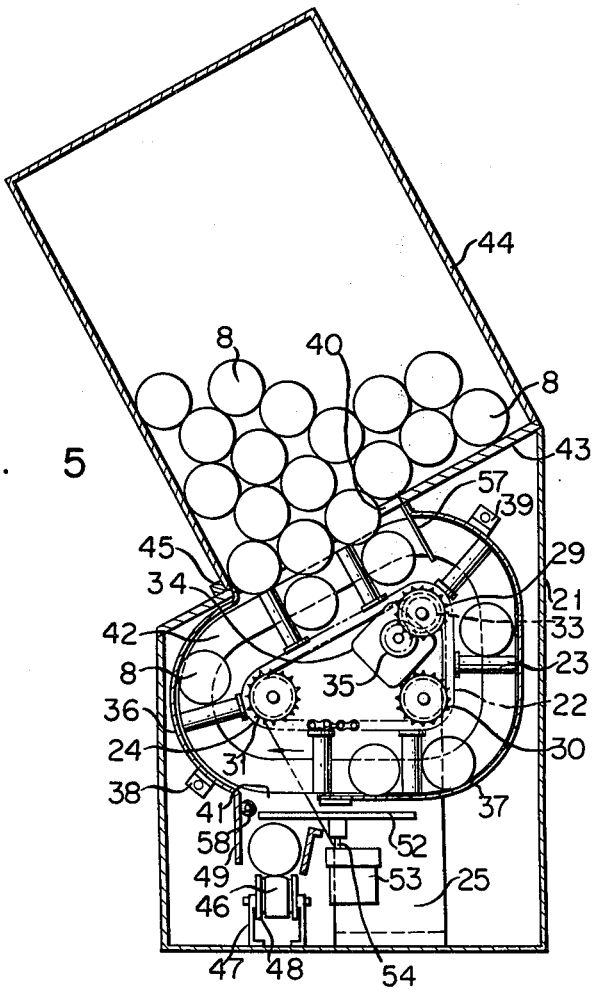
FIG. 5 is a cross-sectional side view of an empty bobbin supply device according to the present invention.
Figure 6:
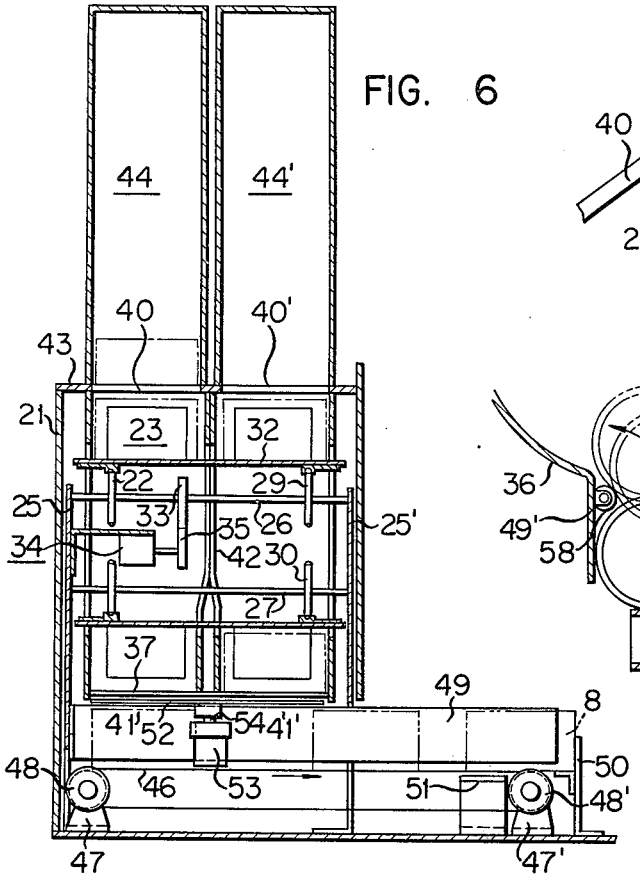
FIG. 6 is a cross-sectional plan view of the device of FIG. 5.

In FIGS. 5 and 6, provided inside a casing 21 of the bobbin supply portion 14, which casing is attached to the side of the doffing portion 13 and has a bottom communicating therewith, are two parallel endless conveyors 24, on which there are provided a plurality of transfer plates 23 on the outer circumference of a chain 22 at a spacing at least greater than the diameter of bobbins, said conveyors being adapted to effect a circulating movement. More particularly, chain wheels 29, 30 and 31 are supported on shafts 26, 27, 28 on supporting plates 25 and 25′, while two chains 22 are engaged around the chain wheels 29, 30 and 31 in the form of a triangle, and there are provided a plurality of plates 32 (FIG. 8) the ends of which are affixed to the chain 22. Transfer plates 23 are attached to certain of the plates 32. According to the embodiment shown, a gear 33 journaled on the shaft 26 meshes with a gear 35 of a motor 34, and the reserve conveyor is driven from the chain wheel 29. Shown at 36 and 37 are guide plates defining a passage along which an empty bobbin is shifted, said guide plates extending along the outer circumference of the reserve conveyor 24 and being secured by brackets 38 and 39 to the casing 21, while having inlets 40 and 40′ and drop-opening 41 and 41′ at the upper and lower ends thereof, respcetively. Furthermore, the side face of the reserve conveyor 24 is covered with an annular guide plate 42 affixed to the guide plates 36 and 37 and extending to the midpoint of the length of the transfer plate 23, thereby precluding the axial displacement of the bobbins.

On the other hand, the upper face of the casing 21 is closed with a partition wall 43 having two openings in register with the inlets 40 and 40′ in the guide plates 36 and 37, said plate 43 being inclined parallel with the upper side of the reserve conveyor 24 and having removably mounted thereon reserve boxes 44 and 44′ which contain empty bobbins 8 therein. The inner width of the reserve boxes 44 and 44′ is somewhat greater than the length of the bobbin 8, and the boxes 44 and 44′ are located on the plate 43, being locked by stoppers 45. As has been referred to earlier, the partition plate 43 is inclined such that the reserve boxes 44 and 44′ will be located in an inclined position, as shown in FIGS. 1 and 4, in the space defined by the upper side 7*a* of the frame of the spinning machine 7, rail 10 and rail supporting frame 10a. Such arrangement of the reserve boxes 44 and 44′ is the most reasonable and efficient utilization of the locations of the reserve boxes 44 and 44′, taking advantage of the upper space of the various types of existing spinning machines, within the small space provided in the doffing portion 13. This further increases the capacity of the reserve boxes containing empty bobbins therein as compared with those placed vertically. In addition to such efficiencies, the bobbins placed on the partition plate 43 move along the plate 43 by gravity toward the inlets 40 and 40', thus precluding the bobbins from remaining within the reserve boxes 44 and 44'.

Provided under the drop-openings 41 and 41' on the lower side of the reserve conveyor 24 is a horizontal transfer conveyor 46 extending to the doffing portion 13. The horizontal transfer conveyor 46 is trained around pulleys 48 and 48' supported for rotation on brackets 47 and 47' spaced a given distance from each other and the conveyor 46 is driven by drive means not shown. Provided on the opposite sides of and above the conveyor 46 are guide pieces 49 and 49' opposed to each other, which define a guiding passage for the bobbins from the drop-openings 41 and 41' to the conveyor 46, while preventing the dropping of the bobbins 8 from the passage during the transfer thereof due to the circulating movement of the conveyor 46.

Provided in the vicinity of the terminal of the conveyor 46 is an arresting piece 50 which arrests the bobbins that have been transferred by the conveyor 46 thereto, thereby bringing the bobbins to a stand-by position until taken up by the bobbin supply arm 19. In addition, in the vicinity of the terminal of the conveyor 46, there is an angle-like horizontal member 51 extending upwardly from the floor surface of the casing 21 to support the upper run to the conveyor 46. When the bobbin 8 in the stand-by position is grasped by the catcher 20 of the bobbin supply arm 19, the upper portion of the horizontal transfer conveyor 46 tends to be deflected downwardly under the load exerted from above, but such a deflection is prevented by the aforesaid horizontal member 51, whereby positive grasping of the bobbin by the catcher 20 is achieved, and there is no adverse effect on the succeeding bobbins.

Figure 7:
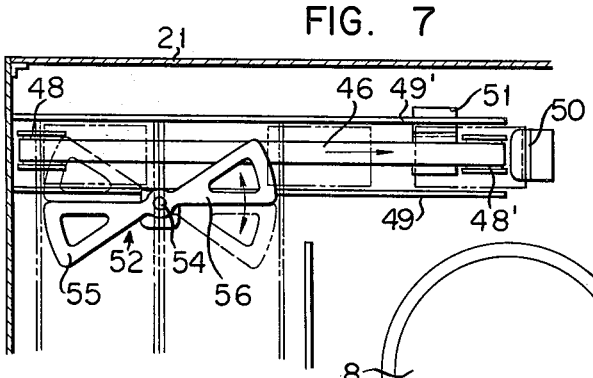
FIG. 7 is a cross-sectional plan view of a bobbin control mechanism as shown in FIGS. 5 and 6.

In FIGS. 5 and 7, a control means 52 is provided somewhat below the guide plate 37 of the reserve conveyor 24, said control means consisting of two sector-shaped control plates 55 and 56 as shown in FIG. 7 driven by a shaft 54 of a motor 53 so as to rotate in either the clockwise or counterclockwise direction in a horizontal plane. The control 52 means is controlled and operated by the motor 53 so that the one control plate is rotated to close the drop-opening 41, the other control plate 56 is rotated to leave the drop-opening 41' open to permit bobbins 8 to be dropped therethrough. Thus, the controlled switching over of the rotational direction of the control means 52 determines from which reserve conveyor 24 the bobbin 8 is to be supplied.

Figure 9:
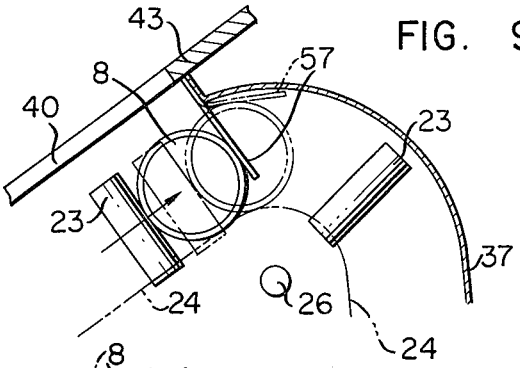
FIG. 9 is an enlarged, partial view illustrating the relationship of a temporary retaining member to bobbins in a bent portion of the reserve conveyor.

As shown in FIG. 9, provided in the vicinity of the reserve conveyor 24 close to the inlets 40 and 40' in the partition plate 43 on the side thereof toward which conveyor is moving is a temporary retaining member 57 in the form of plate spring, one end of which is affixed to the guide plate 37 and which projects within the path of the bobbin 8, such that due to the movement of the reserve conveyor 24, the member 57 will be deflected as shown by the phantom line, being urged by the bobbins or transfer plates 23 out of the path of the bobbins 8 and the transfer plates 23. In addition, shown at 58 in FIG. 5 is a guide roller which is rotatably supported on the lower edge portion of the guide plate 36, said guide roller being positioned so as to contact the bobbins carried on the reserve conveyor 24.

Figure 8:
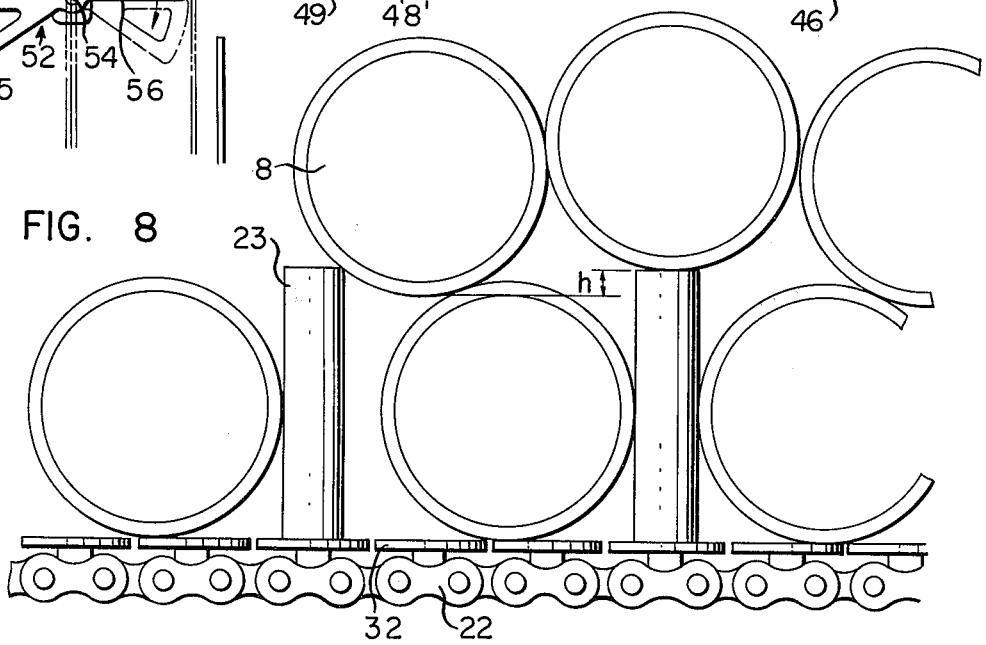
FIG. 8 is an enlarged, partial view illustrating the relationship of a reserve conveyor to bobbins in the vicinity of any inlet as shown in FIG. 5.

In the operation of the empty bobbin supply device of the invention, the reserve boxes 44 and 44' containing a sufficient amount of bobbins 8 are mounted, as shown in FIG. 5, on the partition plate 43, with the openings thereof facing downwards. The chain 22 is driven by the motor 34 through gears 35 and 33, shaft 26 and chain wheel 29 to thereby circulate the reserve conveyor in the direction of the arrow. In this respect, however, when a bobbin 8 is not present between the transfer plates 23 on the reserve conveyor 24, then the bobbins 8 within the reserve boxes 44 and 44' will be dropped through inlets 40 and 40' into the spaces between the transfer plates 23 and the bobbins will be transferred by the reserve conveyor 24. On the other hand, when a bobbin 8 is present between the transfer plates 23 then the bobbins in the lowermost layer within the reserve boxes 44 and 44' will abut the bobbins 8 between te transfer plates 23, rather than dropping into the spaces between the transfer plates 23. In this case, empty bobbins are present on the upper run of the reserve conveyor 24 at all times, being fed by gravity through the passages 40 and 40' from the reserve boxes 44 and 44'. Since the transfer plates 23 are slightly longer than the diameter of the bobbins 8 and the space between the plates is also slightly longer than the bobbin diameter, as shown in FIG. 8, the bobbins in the lowermost layer within the reserve boxes 44 and 44' move up and down by distance or amplitude corresponding to the difference ($h$) between the height of the bobbin held between the transfer plates 23 and that of the transfer plate 23, thereby imparting intermittent movements to the bobbins in a slant direction. Accordingly, such movements positively cause the movements of all the bobbins 8 within reserve boxes, thus preventing the so-called bridge phenomenon created due to the balance in forces on the bobbins which are piled one on top of the other within the boxes.

In addition, in the bent portion of the reserve conveyor 24 where the conveyor runs around the chain wheel 29, as is clear from FIGS. 4 and 9, the space between the tops of the transfer plates 23 will be increased, and thereby there will be provided an excessive spacing between transfer plates 23, such that the bobbins on the conveyor 24 will move to some extent due to the load of the bobbins within the reserve boxes 44 and 44', and then the bobbins in the upper level will drop into the space formed in the rear thereof, thus resulting in the bobbins 8 being held between the upper edge of the guide plate 37 and the transfer plate 23. However, according to the present invention, even if the speed of the transfer plate 23 is increased at the bent portion of the conveyor 24 and the spacing between the transfer plates 23 is also increased, a bobbin 8 will be held under the inlets 40 and 40' by means of the temporary retaining member 57, thereby precluding the bobbins in the upper level from dropping. When the succeeding transfer plate 23 pushes the bobbin 8 due to the circulating movement of the reserve conveyor 24, the temporary retaining member 57 will be deflected to the position shown by phantom line and retracted from the path of the bobbins 8.

As can be readily understood from the foregoing description, the aforesaid temporary retaining member 57 should not necessarily be limited to a member such as a plate spring, but may be made of any flexible materials such as felt, sponge or the like, which protrudes into the path of the bobbins and is affixed to the inner surface of the guide plate 37, as long as it presents a certain amount of resistance to the movement of the bobbins carried between the transfer plates 23 and temporarily prevents the advancing movement thereof in the advancing direction.

The bobbins move downwards by gravity past the bent portion of the reserve conveyor 24 which extends around the chain wheel 29 being restrained by the preceding transfer plate 23, and will rest on the guide plate 37 and will further move past the bent portion where the conveyor extends around the chain wheel 30, and are then pushed by the succeeding transfer plates 23 to move in a horizontal direction. When a bobbin 8 on one of the reserve conveyors 24 reaches the drop-opening 41 or 41', if the control means 52 has been positioned to move the control plates 55 or 56 for that conveyor so that it is retracted away from the drop-opening, the bobbin is dropped from the one reserve conveyor 24 and is positioned on the horizontal transfer conveyor 46.

During the operation of the doffing machine, the horizontal transfer conveyor 46 is driven at all times, and the bobbins 8 placed on the conveyor are guided by the guide pieces 49 and 49' in a line-contact relation with the conveyor 46 and so as not to come off the conveyor 46 moving in the direction of the arrow until they abut the arresting piece 50 at the end of the conveyor and stop thereat, i.e., in the stand-by position for the picking-up operation by the catcher 20 of the bobbin supply arm 19. In this condition the bobbins in the stand-by position are maintained in a line-contact relation with the horizontal transfer conveyor 46, while slipping thereon and being urged against the arresting piece 50 due to the frictional force created by the conveyor 46. Accordingly, the bobbins 8 are maintained in the stand-by position in an optimum position and attitude, despite the doffing machine being moved in front of the spinning units and undergoing vibration. This ensures a positive bobbin grasping action of the catcher 20.

Figure 10:
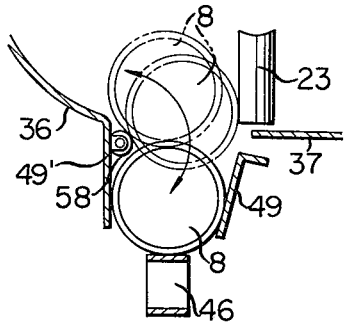
FIG. 10 is an enlarged, partial view showing the relationship of the bobbins to a guide roller in a drop-opening as shown in FIG. 5.
Figure 11:
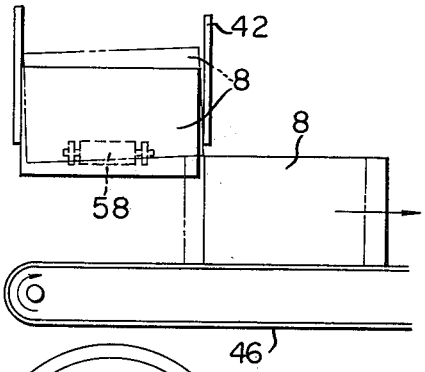
FIG. 11 is a plan view of FIG. 10.

When the horizontal transfer conveyor 46 is full of bobbins 8, a bobbin 8 reaching the drop-opening 41 of the guide plates 36 and 37, as shown in FIGS. 10 and 11, is prevented from dropping by the bobbin 8 positioned on the conveyer 46 and it is then transferred upwardly by being urged by the transfer plate 23 along the circulating path of the reserve conveyor, thus repeating the circulating movement.

The guide roller 58 which is rotatable and provided in each of the drop-openings 41 and 41' abuts the bobbin 8 which is being transferred toward the aforesaid drop-openings 41, 41' and rotates to positively guide the bobbin 8 onto the horizontal transfer conveyor 46 or toward the guide plate 36, thus assisting in shifting of the bobbins in both directions at that point, so that the bobbin is prevented from being held between the transfer plate 23 on the reserve conveyor 24 and the edge portions of the drop openings 41 and 41', thereby permitting a continuous operation of the reserve conveyor 24.

As the doffing operation prceeds, when the bobbins within the reserve box located on one side and on the reserve conveyor 24 are all used, then the motor 34 will be started by means of a manual switch or some appropriate detecting means, thereby rotating the control means 52 to displace the control plate 56, thus causing the empty bobbins to be supplied from the other reserve box 44'. After such a switch-over operation, the empty reserve box is replaced by another reserve box filled with bobbins. However, it should be noted that such a replacement may be carried out at any time, either when the reserve box becomes empty or when the both reserve boxes become empty. In passing, in the aforesaid embodiment, the reserve boxes 44 and 44' are so designed that they can be replaced individually, but they may be replaced in an integral relation. In this case, however, both reserve boxes can be supplied with empty bobbins only when both become empty. However, the operation of the doffing machine 9 need not be interrupted, since a considerable number of empty bobbins still remain on the reserve conveyor 24.

In addition to this, according to the bobbin supply device of the present invention, the bobbins 8 are stored on the reserve conveyor 24 at all times, and only when a bobbin 8 is not present on the horizontal transfer conveyor 46 is the reserve conveyor 24 automatically supplied with bobbins, such that the transferring operations of the reserve conveyor as well as the horizontal transfer conveyor 46 need not be in synchronism with the doffing operation in the doffing portion, nor the operations of the two conveyors 24 and 46.

It will be understood that the above description is merely illustrative of the preferred embodiments of the invention. Additional modifications and improvements can be readily anticipated by those skilled in the art from the present disclosure and such modifications and improvements may fairly be presumed to be within the scope and purview of the invention as defined by the claims which follow.

What is claimed is:

1. An empty bobbin supply device for use in an automatic doffing machine which travels in front of a plurality of spinning units for doffing fully wound cheeses by means of a doffing mechanism and donning empty bobbins in place thereof by means of a donning mechanism, comprising:

bobbin containing means for containing empty bobbins and having an opening in the bottom thereof;

endless conveyor means located in a position under the bottom of said bobbin containing means for separately carrying thereon empty bobbins moving down through the opening of said bobbin containing means and transferring the carried empty bobbins substantially downwardly; and transfer means located in a position below the lower run of said conveyor means for receiving the bobbins coming down from said conveyor means in the absence of a bobbin on said transfer means and transferring the bobbins to the donning mechanism while remaining at a level below the lower run of said conveyor means.

2. An empty bobbin supply device as set forth in claim 1, wherein said bobbin containing means consists of removable boxes having bottom surfaces which have said opening therein inclined toward the spinning units.

3. An empty bobbin supply device as set forth in claim 1, wherein said bobbin containing means is located on the side of a doffing and donning mechanism and contains bobbins in positions with their longitudinal axes in parallel to the length of the frame with the spinning units thereon.

4. An empty bobbin supply device for use in an automatic doffing machine which travels in front of a plurality of spinning units for doffing a fully wound cheese by means of a doffing mechanism and donning empty bobbins in place thereof by means of a donning mechanism, comprising:

a reserve box for containing empty bobbins and having an opening in the bottom thereof adapted to pass said empty bobbins therethrough;

an endless reserve conveyor located under the opening of said reserve box and having a plurality of transfer plates on the circumference thereof spaced at intervals greater than the diameter of the bobbins, said transfer plates protruding outwardly therefrom, said reserve conveyor receiving between said transfer plates the bobbins which come down from said reserve box and transferring said bobbins along the circumference thereof; and transfer means located under said reserve conveyor and in a position spaced downwardly from said reserve conveyor a distance at least equal to the diameter of a bobbin and receiving bobbins from the lower run of said reserve conveyor and transferrring same to a bobbin donning mechanism at a level below the lower run of said reserve conveyor.

5. An empty bobbin supply device as set forth in claim 4, further comprising a second reserve box and a second reserve conveyor arranged side by side with said firstmentioned reserve box in a directing parallel to the direction of movement of said transfer means, and a control means between the first and second reserve conveyors and said transfer means for permitting delivery of bobbins from the lower run of one or the other reserve conveyor to the transfer means.

6. An empty bobbin supply device as set forth in claim 5, wherein each reserve conveyor has a guide plate therearound with an opening along the lower run which permits the passage of bobbins to said transfer means, and said control means consists of two sector-shaped control plates for closing the openings in said reserve conveyor guide plates, said control plates being pivotally mounted between the two reserve conveyors, and a drive means coupled to said control plates for rotating said control plates.

7. an empty bobbin supply device as set forth in claim 4, wherein said reserve conveyor has the upper run facing said opening inclined at an angle toward the spinning units and has a partition plate above said reserve conveyor and inclined parallel to the upper run of said conveyor, said partition plate having an inlet opening corresponding to the opening in said reserve box for dropping the bobbins therethrough, said inlet facing the upper run of said conveyor.

8. An empty bobbin supply device as set forth in claim 7, wherein the transfer plates of said reserve conveyor have a height somewhat greater than the diameter of a bobbin, and the outer circumference of said reserve conveyor has a guide plate therearound having an opening which permits the passage of the bobbins to said transfer means.

9. An empty bobbin supply device as set forth in claim 8, further comprising a temporary retaining means in said reserve conveyor a position along said reserve conveyor just past the opening of said reserve box in the direction of movement of said reserve conveyor, said retaining means engaging a bobbin on the reserve conveyor and being retracted out of the path of the transfer plates as the transfer plates move.

10. An empty bobbin supply device as set forth in claim 9, wherein said temporary retaining means is a resilient plate member having the base portion thereof affixed to the edge of the opening in said guide plate at the reserve box.

11. An empty bobbin supply device as set forth in claim 8, wherein said transfer means is spaced a distance from said guide plate, said distance being greater than the diameter of a bobbin.

12. An empty bobbin supply device as set forth in claim 11, wherein said transfer means consists of a continuously driven endless transfer conveyor, an arresting means for engaging a bobbin at the end of said conveyor remote from said reserve conveyor and a guide means along the sides of said transfer conveyor for guiding bobbins along said conveyor.

13. An empty bobbin supply device as set forth in claim 12, further comprising support means for supporting the upper run of said transfer conveyor from below at said end of said transfer conveyor.

14. An empty bobbin supply device as set forth in claim 13, wherein said support means consists of a channel member having a horizontal member supporting the upper run of said transfer conveyor from below.

15. An empty bobbin supply device as set forth in claim 8, wherein said guide plate has a roller mounted in the opening thereof for rotating in abutting relation with bobbins, said roller being on the side of said opening toward which the lower run of said reserve conveyor is moving.

* * * * *